US007775729B2

(12) United States Patent
Yoshihara

(10) Patent No.: US 7,775,729 B2
(45) Date of Patent: Aug. 17, 2010

(54) DEVELOPING APPARATUS, DEVELOPING PROCESSING METHOD, DEVELOPING PROCESSING PROGRAM, AND COMPUTER READABLE RECORDING MEDIUM RECORDING THE PROGRAM

(75) Inventor: Kousuke Yoshihara, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 615 days.

(21) Appl. No.: 11/739,848

(22) Filed: Apr. 25, 2007

(65) Prior Publication Data

US 2007/0253709 A1 Nov. 1, 2007

(30) Foreign Application Priority Data

Apr. 26, 2006 (JP) ..... 2006-121483
Mar. 22, 2007 (JP) ..... 2007-074068

(51) Int. Cl.
*G03D 5/00* (2006.01)
*G03D 3/02* (2006.01)
*G03C 5/00* (2006.01)
*B05B 3/00* (2006.01)

(52) U.S. Cl. ..... 396/611; 396/627; 118/323; 430/434

(58) Field of Classification Search ..... 396/611, 396/327, 627; 118/323; 430/434; 355/27
See application file for complete search history.

(56) References Cited

U.S. PATENT DOCUMENTS

2009/0130614 A1* 5/2009 Ookouchi et al. ..... 430/434

FOREIGN PATENT DOCUMENTS

| | | |
|---|---|---|
| JP | 57-208135 | * 12/1982 |
| JP | 7-263302 | 10/1995 |
| JP | 2005-210059 | 8/2005 |

OTHER PUBLICATIONS

Abstract to JP 57-208135 (dated Dec. 1982).*
English translation of JP 07-263302 (dated Oct. 1995).*

* cited by examiner

*Primary Examiner*—Alan A Mathews
(74) *Attorney, Agent, or Firm*—Oblon, Spivak, McClelland, Maier & Neustadt, L.L.P.

(57) ABSTRACT

A developing apparatus, a developing processing method, a developing processing program, and a computer readable recording medium recording the program, which can reduce the consumption amount of the developing solution and the developing processing time irrespective of the type of resist materials or the shape of resist patterns, are provided. A step of horizontally holding a substrate and rotating the substrate around a vertical axis at a prescribed rotation rate, and a step of intermittently supplying a developing solution to a center of the substrate from a discharge port of a developing solution nozzle arranged opposing to the surface of the substrate are executed. In the step of intermittently supplying the developing solution to the center of the substrate, an intermittence time and a substrate rotation rate in the intermittence time are set to prevent the developing solution supplied to the substrate from drying.

27 Claims, 13 Drawing Sheets

FIG.6

| STEP | PROCESSING TIME | WAFER | | DEVELOPING SOLUTION NOZZLE | | PROCESSING DESCRIPTION |
|---|---|---|---|---|---|---|
| | sec | ROTATION RATE (rpm) | ACCELERATION (rpm/s) | POSITION | RATE (mm/s) | |
| S1 | 1.0 | 500 | 3000 | CENTER | 150 | MOVE NOZZLE |
| S2 | 0.5 | 500 | 3000 | CENTER | 150 | PREWET |
| S3 | 1.0 | 500 | 3000 | START POSITION | 150 | PREWET |
| S4 | 0.1 | 500 | 3000 | START POSITION | 150 | WAITING |
| S5 | 0.1 | 1000 | 3000 | START POSITION | 150 | SUPPLY DEVELOPING SOLUTION |
| S6 | 1.0 | 1000 | 3000 | CENTER | 75 | SUPPLY DEVELOPING SOLUTION |
| S7 | 2.5 | 750 | 3000 | CENTER | 150 | STOP DISCHARGING |
| S8 | 2.5 | 1000 | 3000 | CENTER | 150 | SUPPLY DEVELOPING SOLUTION |
| S9 | 2.5 | 750 | 3000 | CENTER | 150 | STOP DISCHARGING |
| S10 | 2.5 | 1000 | 3000 | CENTER | 150 | SUPPLY DEVELOPING SOLUTION |
| S11 | 0.5 | 100 | 3000 | CENTER | 150 | WAITING |
| S12 | 2.0 | 100 | 3000 | CENTER | 150 | RINSE |
| S13 | 3.0 | 1200 | 3000 | CENTER | 150 | RINSE |
| S14 | 10.0 | 500 | 3000 | CENTER | 150 | RINSE |
| S15 | 15.0 | 2000 | 3000 | START POSITION | 150 | DRY PROCESSING |
| S16 | 5.0 | 0 | 3000 | WAITING POSITION | 150 | WAITING |
| S17 | – | – | – | – | – | – |

R1

INTERMITTENT DISCHARGING TO CENTER OF WAFER

FIG.10

| STEP | PROCESSING TIME | WAFER | | DEVELOPING SOLUTION NOZZLE | | PROCESSING DESCRIPTION |
|---|---|---|---|---|---|---|
| | sec | ROTATION RATE (rpm) | ACCELERATION (rpm/s) | POSITION | RATE (mm/s) | |
| S1 | 1.0 | 500 | 3000 | CENTER | 150 | MOVE NOZZLE |
| S2 | 0.5 | 500 | 3000 | CENTER | 150 | PREWET |
| S3 | 1.0 | 500 | 3000 | START POSITION | 150 | PREWET |
| S4 | 0.1 | 500 | 3000 | START POSITION | 150 | WAITING |
| S5 | 0.1 | 1000 | 3000 | START POSITION | 150 | SUPPLY DEVELOPING SOLUTION |
| S6 | 1.0 | 1000 | 3000 | CENTER | 75 | SUPPLY DEVELOPING SOLUTION |
| S7 | 10.0 | 1000 | 3000 | CENTER | 150 | SUPPLY DEVELOPING SOLUTION |
| S8 | 0.5 | 100 | 3000 | CENTER | 150 | WAITING |
| S9 | 2.0 | 100 | 3000 | CENTER | 150 | RINSE |
| S10 | 3.0 | 1200 | 3000 | CENTER | 150 | RINSE |
| S11 | 10.0 | 500 | 3000 | CENTER | 150 | RINSE |
| S12 | 15.0 | 2000 | 3000 | START POSITION | 150 | DRY PROCESSING |
| S13 | 5.0 | 0 | 3000 | WAITING POSITION | 150 | WAITING |
| S14 | – | – | – | – | – | – |

R2

CONTINUOUS DISCHARGING TO CENTER OF WAFER

FIG.11

| STEP | PROCESSING TIME | WAFER | | DEVELOPING SOLUTION NOZZLE | | PROCESSING DESCRIPTION |
|---|---|---|---|---|---|---|
| | sec | ROTATION RATE (rpm) | ACCELERATION (rpm/s) | POSITION | RATE (mm/s) | |
| S1 | 1.0 | 500 | 3000 | CENTER | 150 | MOVE NOZZLE |
| S2 | 0.5 | 500 | 3000 | CENTER | 150 | PREWET |
| S3 | 1.0 | 500 | 3000 | START POSITION | 150 | PREWET |
| S4 | 0.1 | 500 | 3000 | START POSITION | 150 | WAITING |
| S5 | 0.1 | 1000 | 3000 | START POSITION | 150 | SUPPLY DEVELOPING SOLUTION |
| S6 | 1.0 | 1000 | 3000 | CENTER | 75 | SUPPLY DEVELOPING SOLUTION |
| S7 | 2.5 | 750 | 3000 | CENTER | 150 | STOP DISCHARGING |
| S8 | 2.5 | 1000 | 3000 | CENTER | 150 | SUPPLY DEVELOPING SOLUTION |
| S9 | 2.5 | 750 | 3000 | CENTER | 150 | STOP DISCHARGING |
| S10 | 2.5 | 1000 | 3000 | CENTER | 150 | SUPPLY DEVELOPING SOLUTION |
| S11 | 2.5 | 750 | 3000 | CENTER | 150 | STOP DISCHARGING |
| S12 | 2.5 | 1000 | 3000 | CENTER | 150 | SUPPLY DEVELOPING SOLUTION |
| S13 | 0.5 | 100 | 3000 | CENTER | 150 | WAITING |
| S14 | 2.0 | 100 | 3000 | CENTER | 150 | RINSE |
| S15 | 3.0 | 1200 | 3000 | CENTER | 150 | RINSE |
| S16 | 10.0 | 500 | 3000 | CENTER | 150 | RINSE |
| S17 | 15.0 | 2000 | 3000 | START POSITION | 150 | DRY PROCESSING |
| S18 | 5.0 | 0 | 3000 | WAITING POSITION | 150 | WAITING |
| S19 | – | – | – | – | – | – |

R3

INTERMITTENT DISCHARGING TO CENTER OF WAFER

FIG.12

| STEP | PROCESSING TIME | WAFER | | DEVELOPING SOLUTION NOZZLE | | PROCESSING DESCRIPTION |
|---|---|---|---|---|---|---|
| | sec | ROTATION RATE (rpm) | ACCELERATION (rpm/s) | POSITION | RATE (mm/s) | |
| S1 | 1.0 | 500 | 3000 | CENTER | 150 | MOVE NOZZLE |
| S2 | 0.5 | 500 | 3000 | CENTER | 150 | PREWET |
| S3 | 1.0 | 500 | 3000 | START POSITION | 150 | PREWET |
| S4 | 0.1 | 500 | 3000 | START POSITION | 150 | WAITING |
| S5 | 0.1 | 1000 | 3000 | START POSITION | 150 | SUPPLY DEVELOPING SOLUTION |
| S6 | 1.0 | 1000 | 3000 | CENTER | 75 | SUPPLY DEVELOPING SOLUTION |
| S7 | 15.0 | 1000 | 3000 | CENTER | 150 | SUPPLY DEVELOPING SOLUTION |
| S8 | 0.5 | 100 | 3000 | CENTER | 150 | WAITING |
| S9 | 2.0 | 100 | 3000 | CENTER | 150 | RINSE |
| S10 | 3.0 | 1200 | 3000 | CENTER | 150 | RINSE |
| S11 | 10.0 | 500 | 3000 | CENTER | 150 | RINSE |
| S12 | 15.0 | 2000 | 3000 | START POSITION | 150 | DRY PROCESSING |
| S13 | 5.0 | 0 | 3000 | WAITING POSITION | 150 | WAITING |
| S14 | – | – | – | – | – | – |

R4

CONTINUOUS DISCHARGING TO CENTER OF WAFER

FIG.14

| STEP | PROCESSING TIME | WAFER | | DEVELOPING SOLUTION NOZZLE | | PROCESSING DESCRIPTION |
|---|---|---|---|---|---|---|
| | sec | ROTATION RATE (rpm) | ACCELERATION (rpm/s) | POSITION | RATE (mm/s) | |
| S1 | 1.0 | 500 | 3000 | CENTER | 150 | MOVE NOZZLE |
| S2 | 0.5 | 500 | 3000 | CENTER | 150 | PREWET |
| S3 | 1.0 | 500 | 3000 | START POSITION | 150 | PREWET |
| S4 | 0.1 | 500 | 3000 | START POSITION | 150 | WAITING |
| S5 | 0.1 | 1000 | 3000 | START POSITION | 150 | SUPPLY DEVELOPING SOLUTION |
| S6 | 1.0 | 1000 | 3000 | CENTER | 75 | SUPPLY DEVELOPING SOLUTION |
| S7 | 3 | 1000 | 3000 | CENTER | 150 | SUPPLY DEVELOPING SOLUTION |
| S8 | 7 | 100 | 3000 | CENTER | 150 | STOP SUPPLY |
| S9 | 0.5 | 100 | 3000 | CENTER | 150 | WAITING |
| S10 | 2.0 | 100 | 3000 | CENTER | 150 | RINSE |
| S11 | 3.0 | 1200 | 3000 | CENTER | 150 | RINSE |
| S12 | 10.0 | 500 | 3000 | CENTER | 150 | RINSE |
| S13 | 15.0 | 2000 | 3000 | START POSITION | 150 | DRY PROCESSING |
| S14 | 5.0 | 0 | 3000 | WAITING POSITION | 150 | WAITING |
| S15 | – | – | – | – | – | – |

R5

CONTINUOUS DISCHARGING TO CENTER OF WAFER

DEVELOPING APPARATUS, DEVELOPING PROCESSING METHOD, DEVELOPING PROCESSING PROGRAM, AND COMPUTER READABLE RECORDING MEDIUM RECORDING THE PROGRAM

BACKGROUND OF THE INVENTION

1. Field of the Invention

The present invention relates to a developing apparatus, a developing processing method, a developing processing program, and a computer readable recording medium recording the program, for performing developing processing on a substrate having been coated with a resist and subjected to exposing processing.

2. Description of the Background Art

For example in manufacturing a semiconductor device, a circuit pattern is formed by what is called the photolithography technique. Specifically, a prescribed film is deposited on a wafer that is a substrate to be processed and, thereafter, a photoresist solution is coated thereon to form a resist film. The resist film is exposed corresponding to a circuit pattern, and then subjected to developing processing. In the photolithography technique, the wafer that is a substrate to be processed is subjected to a series of processing including main steps of: cleaning processing→dehydration baking→adhesion (hydrophobizing) processing→resist coating→pre-baking→exposing→developing→post-baking, so that a prescribed circuit pattern is formed at the resist layer.

In a conventional developing apparatus, for example as shown in FIGS. 13A-13C, a wafer W is horizontally held over a substrate holding portion 51, and a developing solution nozzle 52 is arranged such that its small diameter discharge port is located slightly higher than the surface of wafer W.

Then, wafer W is rotated around a vertical axis, and developing solution nozzle 52 is moved in a radial direction relative to the rotational axis of wafer W while a developing solution is discharged form developing solution nozzle 52. This causes the developing solution to be accumulated on the surface of wafer W in a spiral manner (FIG. 13A).

Then, wafer W with developing solution 53 accumulated on its surface is left for a predetermined developing time, e.g., 60 seconds, to cause the stationary development (referred to as the stationary puddle scheme) (FIG. 13B). Thereafter, a rinse liquid 55, e.g., pure water, is supplied to the center of wafer W from a rinse liquid nozzle 54 (FIG. 13C). As a result, the portions of the resist insoluble in the developing solution remain, forming a prescribed resist pattern (see Japanese Patent Laying-Open No. 07-263302, for example).

However, the developing method described above referring to FIGS. 13A-13C suffers from the following problem. Specifically, when the resist processing is performed by the stationary puddle scheme disclosed in Japanese Patent Laying-Open No. 07-263302, as the resist is generally hydrophobic, a pullback phenomenon, i.e., drops of solution on wafer W pulling at each other by surface tension, occurs if the amount of developing solution accumulated on wafer W is too small. As a result, some portions may not be developed (may not be coated with the developing solution). To overcome this problem, it has been necessary to supply the surface of wafer W with a large amount of developing solution, so that the entire surface is covered with the developing solution regardless of drops of solution pulling at each other by surface tension. As a result, the amount of developing solution being used has been great.

One of solutions for the foregoing problem is a developing processing method disclosed in Japanese Patent Laying-Open No. 2005-210059, in which a wafer is rotated around a vertical axis, and a developing solution nozzle is moved from the outside of the wafer toward the central portion of the wafer while a strip-like developing solution extending in a radial direction relative to the rotational axis of wafer W is discharged from a nozzle discharge port. This causes the developing solution to be coated on the surface of the wafer in a spiral manner.

According to the method, by setting the longer width of the discharge port to be greater, wide strips of developing solution can be aligned in the radial direction of the wafer without any gap, whereby the developing solution can easily be coated on the entire wafer. By setting the shorter width of the discharge port to be smaller, the thickness of the developing solution coated on the wafer surface can be reduced. As a result, the consumption amount of the developing solution can be reduced.

Furthermore, according to the developing method disclosed in Japanese Patent Laying-Open No. 2005-210059, not the stationary puddle scheme but a puddleless scheme (rotary developing scheme) is employed, in which rotation of a wafer is continued during development and a developing solution is supplied to the center of the wafer until the development is finished. According to the puddleless scheme, by the rotation of the wafer (centrifugal force), the dissolved components of the resist can be removed together with the developing solution during the development while a new resist is constantly supplied. Thus, the developing processing can proceed efficiently.

SUMMARY OF THE INVENTION

Meanwhile, in the puddleless scheme as described above, the developing time is adjusted by the time during which a developing solution is supplied to a wafer. The developing time is determined in accordance with the conditions such as the type of resist material, the resist pattern to be developed and the like.

When the resist material with a low dissolving rate is used, or when a resist pattern of which resolution is difficult in terms of an optical image, i.e., a fine pattern, a hole-type pattern and the like, is formed, a long developing time has been required. That is, there has been a problem that, if a long developing time is set, the time during which the developing solution is discharged to the center of the wafer is increased, whereby the consumption amount of the developing solution is increased. Thus, the superiority over the stationary puddle scheme cannot be maintained.

The present invention has been made under the circumstances described above, and an object thereof is to provide a developing apparatus, a developing processing method, a developing processing program, and a computer readable recording medium recording the program, which can reduce the consumption amount of the developing solution and the developing processing time irrespective of the type of resist materials or the shape of resist patterns.

In order to solve the aforementioned problem, a developing apparatus according to the present invention is directed to a developing apparatus for performing developing processing on a substrate having its surface coated with a resist and exposed, including: a substrate holding portion horizontally holding the substrate; a rotary drive mechanism rotating the substrate holding portion around a vertical axis; a developing solution nozzle that is arranged opposing to the surface of the substrate held by the substrate holding portion and that has a discharge port discharging a developing solution; a developing solution supplying portion supplying the developing solution to the developing solution nozzle; and a control unit controlling operations of the rotary drive mechanism and the developing solution supplying portion. The control unit controls the rotary drive mechanism such that the substrate rotates around the vertical axis at a prescribed rotation rate, and controls the developing solution supplying portion such that the developing solution is intermittently supplied from the discharge port of the developing solution nozzle to a center of the substrate.

With such a configuration, the developing solution is intermittently supplied to the center of the substrate of which rotation is controlled, during which the developing processing is carried out. In this intermittently supplying period, when the developing solution is discharged after an intermittence, a large amount of developing solution gushes onto the substrate center. This efficiently flushes the resist dissolution components on the substrate away, accelerating the developing processing and reducing the developing time. Further, by exerting the control so as to prevent the developing solution on the substrate from drying when the developing solution discharging is stopped in the processing of intermittently supplying the developing solution, the developing processing can continuously proceed. As a result, the consumption amount of the developing solution can be reduced than in the conventional puddleless scheme.

Desirably, the developing apparatus further includes a moving mechanism moving the developing solution nozzle from a periphery of the substrate toward the center of the substrate. The control unit controls the rotary drive mechanism such that the substrate rotates around the vertical axis at a prescribed rotation rate. The control unit controls, before the developing solution is intermittently supplied to the center of the substrate, the developing solution supplying portion and the moving mechanism such that the developing solution nozzle is moved from the periphery of the substrate to the center of the substrate while the developing solution is discharged from the discharge port of the developing solution nozzle to spirally supply the developing solution to the surface of the substrate.

With such a configuration, dissolution of the resist is started before the developing solution is intermittently supplied, whereby the effect by the intermittent supply becomes further effective. Further, since the developing solution is coated over the entire substrate surface, the developing solution spreads effectively over the entire substrate surface when the developing solution is discharged onto the substrate center, achieving further even developing processing of the entire substrate surface.

In order to solve the aforementioned problem, the present invention is directed to a developing processing method of performing developing processing on a substrate having its surface coated with a resist and exposed, includes the steps of: horizontally holding the substrate and rotating the substrate around a vertical axis at a prescribed rotation rate; and intermittently supplying a developing solution to a center of the substrate, from a discharge port of a developing solution nozzle arranged opposing to the surface of the substrate. In the step of intermittently supplying the developing solution to the center of the substrate, an intermittence time and a rotation rate of the substrate in the intermittence time are set to prevent the developing solution supplied to the substrate from drying.

With such a method including the steps, by intermittently supplying the developing solution to the center of the substrate, when the developing solution is discharged after an intermittence, a large amount of developing solution gushes onto the substrate center. This efficiently flushes the resist dissolution components on the substrate away, accelerating the developing processing and reducing the developing time.

Further, by setting an intermittence time in the processing of intermittently supplying the developing solution and a rotation rate of the substrate in the intermittence time so as to prevent the developing solution on the substrate from drying when the developing solution discharging is stopped, the developing processing can continuously proceed. As a result, the consumption amount of the developing solution can be reduced than in the conventional puddleless scheme. Additionally, since the developing solution does not dry on the substrate, the fixing of the dissolved components of the resist can be suppressed and occurrence of dry spots is prevented.

Desirably, before the step of intermittently supplying the developing solution to the center of the substrate, the developing processing method further includes a step of moving the developing solution nozzle from a periphery of the substrate to the center of the substrate while the developing solution is discharged from the discharge port of the developing solution nozzle to spirally supply the developing solution to the surface of the substrate.

With such a configuration, dissolution of the resist is started before the developing solution is intermittently supplied, whereby the effect by the intermittent supply becomes further effective. Further, since the developing solution is coated over the entire substrate surface, the developing solution spreads effectively over the entire substrate surface when the developing solution is discharged onto the substrate center, achieving further even developing processing of the entire substrate surface.

Desirably, in the step of intermittently supplying the developing solution to the center of the substrate, a substrate rotation rate and an intermittence time being set to prevent the developing solution supplied to the substrate from drying are one of the following: at most 1000 rpm and at most 2.0 seconds, respectively; at most 750 rpm and at most 2.5 seconds, respectively; and at most 500 rpm and at most 3.5 seconds, respectively.

By setting the intermittence time in the period of intermittently supplying the developing solution and the substrate rotation rate in the intermittence as above, the developing solution on the substrate can be prevented from drying when the discharging of the developing solution is stopped.

According to the present invention, a developing apparatus, a developing processing method, a developing processing program, and a computer readable recording medium recording the program can be provided, which can reduce the consumption amount of the developing solution and the developing processing time irrespective of the type of resist materials or the shape of resist patterns.

A developing apparatus for performing developing processing on a substrate having its surface coated with a resist and exposed includes: a substrate holding portion horizontally holding the substrate; a rotary drive mechanism rotating the substrate holding portion around a vertical axis; a developing solution nozzle that is arranged opposing to the surface of the substrate held by the substrate holding portion and that has a discharge port discharging a developing solution; a developing solution supplying portion supplying the developing solution to the developing solution nozzle; and a control unit controlling operations of the rotary drive mechanism and the developing solution supplying portion. The control unit controls the rotary drive mechanism such that the substrate rotates around the vertical axis at a prescribed rotation rate, and controls the developing solution supplying portion such that supply of the developing solution from the discharge port of the developing solution nozzle to a center of the substrate is temporarily stopped.

Preferably, the control unit controls the rotary drive mechanism such that the substrate rotates around the vertical axis at a prescribed rotation rate, and controls the developing solution supplying portion such that the developing solution is intermittently supplied from the discharge port of the developing solution nozzle to the center of the substrate.

Preferably, the control unit controls the rotary drive mechanism such that the substrate rotates around the vertical axis at a prescribed rotation rate, temporarily stops the supply of the developing solution during the developing processing, and reduces the rotation rate of the substrate during the temporal stop than before the temporal stop.

Preferably, a time of temporarily stopping the supply of the developing solution and the rotation rate of the substrate are controlled to be a time of temporarily stopping the supply of the developing solution and a rotation rate with which a film of the developing solution is held over the surface of the substrate.

Preferably, the developing apparatus further includes a moving mechanism moving the developing solution nozzle from a periphery of the substrate toward the center of the substrate. The control unit controls the rotary drive mechanism such that the substrate rotates around the vertical axis at a prescribed rotation rate, and controls, before the developing solution is intermittently supplied to the center of the substrate, the developing solution supplying portion and the moving mechanism such that the developing solution nozzle is moved from the periphery of the substrate to the center of the substrate while the developing solution is discharged from the discharge port of the developing solution nozzle to spirally supply the developing solution to the surface of the substrate.

A developing processing method of performing developing processing on a substrate having its surface coated with a resist and exposed includes the steps of: horizontally holding the substrate and rotating the substrate around a vertical axis at a prescribed rotation rate; and intermittently supplying a developing solution to a center of the substrate, from a discharge port of a developing solution nozzle arranged opposing to the surface of the substrate. An intermittence time and a rotation rate of the substrate in the intermittence time are set to prevent the developing solution supplied to the substrate from drying.

Preferably, the developing processing method further includes, before the step of intermittently supplying the developing solution to the center of the substrate, a step of moving the developing solution nozzle from a periphery of the substrate to the center of the substrate while the developing solution is discharged from the discharge port of the developing solution nozzle to spirally supply the developing solution to the surface of the substrate.

Preferably, the step of horizontally holding the substrate and rotating the substrate includes a step of holding the substrate and rotating the substrate around a vertical axis at a prescribed rotation rate for a prescribed time in a state where discharge of the developing solution from the developing solution nozzle is stopped, wherein a substrate rotation rate and a substrate holding time are at most 1000 rpm and at most 2.0 seconds, respectively.

Preferably, in the step of intermittently supplying the developing solution to the center of the substrate, a substrate rotation rate and an intermittence time being set to prevent the developing solution supplied to the substrate from drying are at most 750 rpm and at most 2.5 seconds, respectively.

Preferably, in the step of intermittently supplying the developing solution to the center of the substrate, a substrate rotation rate and an intermittence time being set to prevent the developing solution supplied to the substrate from drying are at most 500 rpm and at most 3.5 seconds, respectively.

Preferably, in the step of intermittently supplying the developing solution to the center of the substrate, a substrate rotation rate and an intermittence time being set to prevent the developing solution supplied to the substrate from drying are at most 200 rpm and at least 5.0 seconds, respectively.

A program is for causing a computer to execute the aforementioned developing processing method.

A computer readable recording medium records the aforementioned program.

A developing processing method of performing developing processing on a substrate having its surface coated with a resist and exposed, includes the steps of: horizontally holding the substrate and rotating the substrate around a vertical axis at a prescribed rotation rate; moving a developing solution nozzle from a periphery of the substrate to a center of the substrate while a developing solution is discharged from a discharge port of the developing solution nozzle arranged opposing to the surface of the substrate; stopping discharge of the developing solution from the developing solution nozzle after the developing solution nozzle reached above the center of the substrate; and holding the substrate and rotating the substrate around a vertical axis at a prescribed rotation rate for a prescribed time in a state where discharge of the developing solution from the developing solution nozzle is stopped.

Preferably, in the step of stopping discharge of the developing solution from the developing solution nozzle after the developing solution nozzle reached above the center of the substrate, during a prescribed time after the developing solution nozzle reached above the center of the substrate and until discharge of the developing solution is stopped, the developing solution is continuously discharged or intermittently discharged from the nozzle to the surface of the substrate.

Preferably, in the step of holding the substrate and rotating the substrate around a vertical axis at a prescribed rotation rate for a prescribed time in a state where discharge of the developing solution from the developing solution nozzle is stopped, a substrate rotation rate and a substrate holding time are at most 1000 rpm and at most 2.0 seconds, respectively.

Preferably, in the step of holding the substrate and rotating the substrate around a vertical axis at a prescribed rotation rate for a prescribed time in a state where discharge of the developing solution from the developing solution nozzle is stopped, a substrate rotation rate and a substrate holding time are at most 750 rpm and at most 2.5 seconds, respectively.

Preferably, in the step of holding the substrate and rotating the substrate around a vertical axis at a prescribed rotation rate for a prescribed time in a state where discharge of the developing solution from the developing solution nozzle is stopped, a substrate rotation rate and a substrate holding time are at most 500 rpm and at most 3.5 seconds, respectively.

Preferably, in the step of holding the substrate and rotating the substrate around a vertical axis at a prescribed rotation rate for a prescribed time in a state where discharge of the developing solution from the developing solution nozzle is stopped, a substrate rotation rate and a substrate holding time are at most 200 rpm and at least 5.0 seconds, respectively.

A program is for causing a computer to execute the developing processing method.

A computer readable recording medium recording the program.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 shows an example of a processing recipe executed by the developing unit shown in FIG. 3.

FIG. 10 shows a processing recipe in Comparative Example 1.

FIG. 11 shows a processing recipe in Experiment 2.

FIG. 12 shows a processing recipe in Comparative Example 2.

FIG. 14 shows a processing recipe in Experiment 4.

DESCRIPTION OF THE PREFERRED EMBODIMENTS

Figure 1:
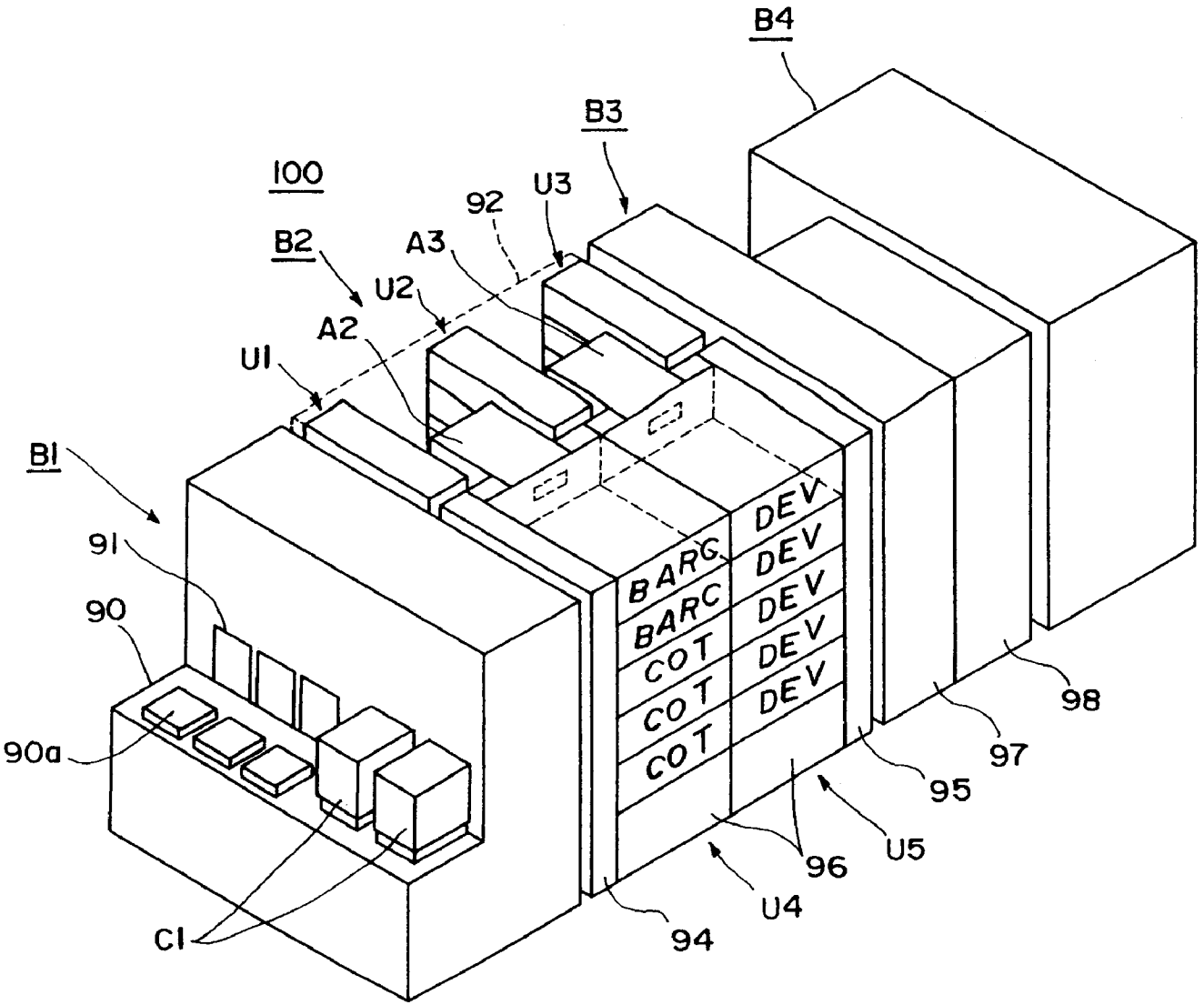
FIG. 1 is a perspective view showing an overall configuration of a coating and developing apparatus that includes a developing apparatus according to the present invention.
Figure 2:
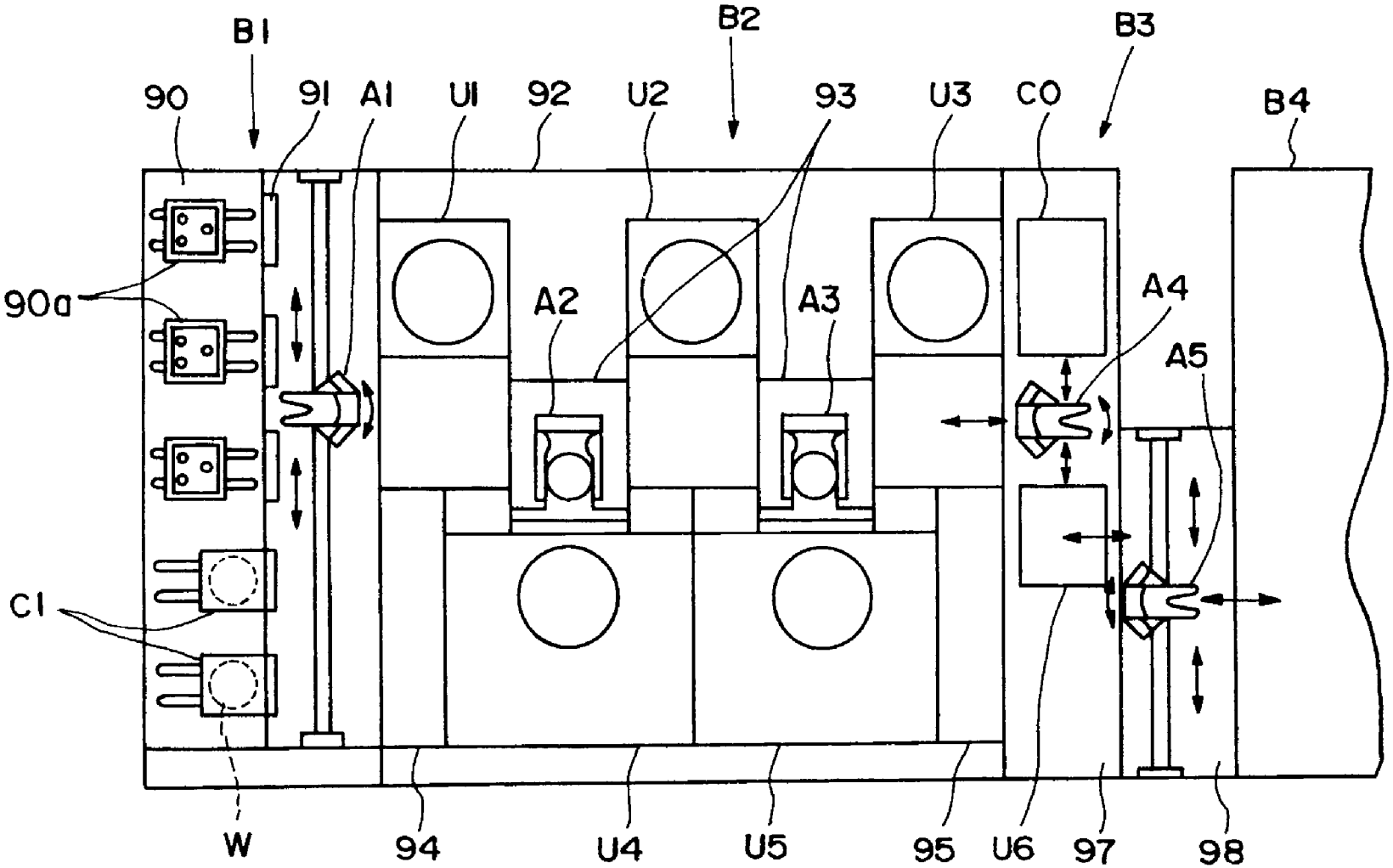
FIG. 2 is a plan view showing an overall configuration of a coating and developing apparatus that includes a developing apparatus according to the present invention.

In the following, embodiments of the present invention will be described referring to the drawings. FIGS. 1 and 2 are perspective view and plan view, respectively, of an overall configuration of a coating and developing apparatus that includes a developing apparatus according to the present invention. First, this resist coating and developing apparatus 100 is described. In resist coating and developing apparatus 100, in the drawing, a carrier placing portion B1 is shown, which is for putting in and taking out a carrier C1 in which for example 13 wafers W being substrates are stored with sealing. Carrier placing portion B1 is provided with a carrier station 90 having a placing portion 90*a* on which a plurality of carriers C1 can be placed, an opening and closing portion 91 provided at a front wall surface as seen from carrier station 90, and a transferring means A1 for taking out wafer W from carrier C1 via opening and closing portion 91.

At the back of carrier placing portion B1, a processing portion B2 surrounded by a housing 92 is connected. In processing portion B2, from the front side toward the back side, shelf units U1, U2 and U3, which are multiple stages of heating and cooling units, and main carrying means A2 and A3 for transferring wafers W between processing units including coating and developing units, which will be described later, are provided in an alternating arrangement. That is, shelf units U1, U2 and U3 and main carrying means A2 and A3 are arranged in a line in tandem as seen from carrier placing portion B1. A not-shown opening for carrying wafers is formed at each connecting portion. Wafer W can freely move inside processing portion B2 from shelf unit U1 on one side to shelf unit U3 on the other side.

Main carrying means A2 and A3 are placed in a space enclosed by a partition wall 93 constituted of: one plane on the side of shelf units U1, U2 and U3 arranged in the tandem direction as seen from carrier placing portion B1; one plane on the side of liquid processing units U4 and U5, which are on the right side for example and will be described later; and a back plane that is a plane on the left side. Temperature and humidity adjusting units 94 and 95 are provided, which include a temperature adjusting apparatus for a processing liquid used in each unit, a duct for adjusting temperature and humidity and the like.

Liquid processing units U4 and U5 each have a configuration in which, as shown in FIG. 1 for example, on a storage portion 96 forming a space for supplying solution such as a coating solution (resist solution) or a developing solution, coating units COT, developing units DEV as the developing apparatuses of the present invention, and reflection preventing film formation units BARC and the like are stacked to form a plurality of stages, e.g., five stages. The aforementioned shelf units U1, U2 and U3 each have a configuration in which various units for performing pre-processing and post-processing of processing performed at liquid processing units U4 and U5 are staked to form a plurality of stages, e.g., ten stages. Included therein are heating units for heating (baking) wafer W, cooling units for cooling wafer W and the like.

On the back side of shelf unit U3 in processing portion B2, an exposing portion B4 is connected via an interface portion B3 constituted of a first carrying chamber 97 and a second carrying chamber 98, for example. Inside interface portion B3, besides two transferring means A4 and A5 for transferring wafer W between processing portion B2 and exposing portion B4 as shown in FIG. 2, a shelf unit U6 and a buffer carrier C0 are provided.

An exemplary flow of wafers W in the apparatus is described in the following. First, carrier C1 in which wafers W are stored is externally placed on placement table 90. Together with opening and closing portion 91, a lid of carrier C1 is removed and wafers W are taken out by transferring means A1. Then, wafers W are transferred to main carrying means A2 via a transfer unit (not shown) constituting one stage of shelf unit U1. At one of shelves of shelf units U1-U3, for example reflection preventing film formation processing and cooling processing are performed as pre-processing of coating processing, and thereafter a resist solution is coated at coating unit COT.

Thereafter, wafer W are heated (bake processing) at the heating unit constituting one shelf of shelf units U1-U3, and further cooled. Thereafter, via the transfer unit of shelf unit U3, they are put into interface portion B3. In interface portion B3, wafers W are carried, for example, via a course of transferring means A4→shelf unit U6→transferring means A5, to exposing portion B4, where exposure is performed. After the exposure, wafers W are carried to main carrying means A2 via the reverse course and developed at developing unit DEV. Thus, a resist mask is formed. Thereafter, wafers W are returned to the original carrier C1 on placement table 90.

Figure 3:
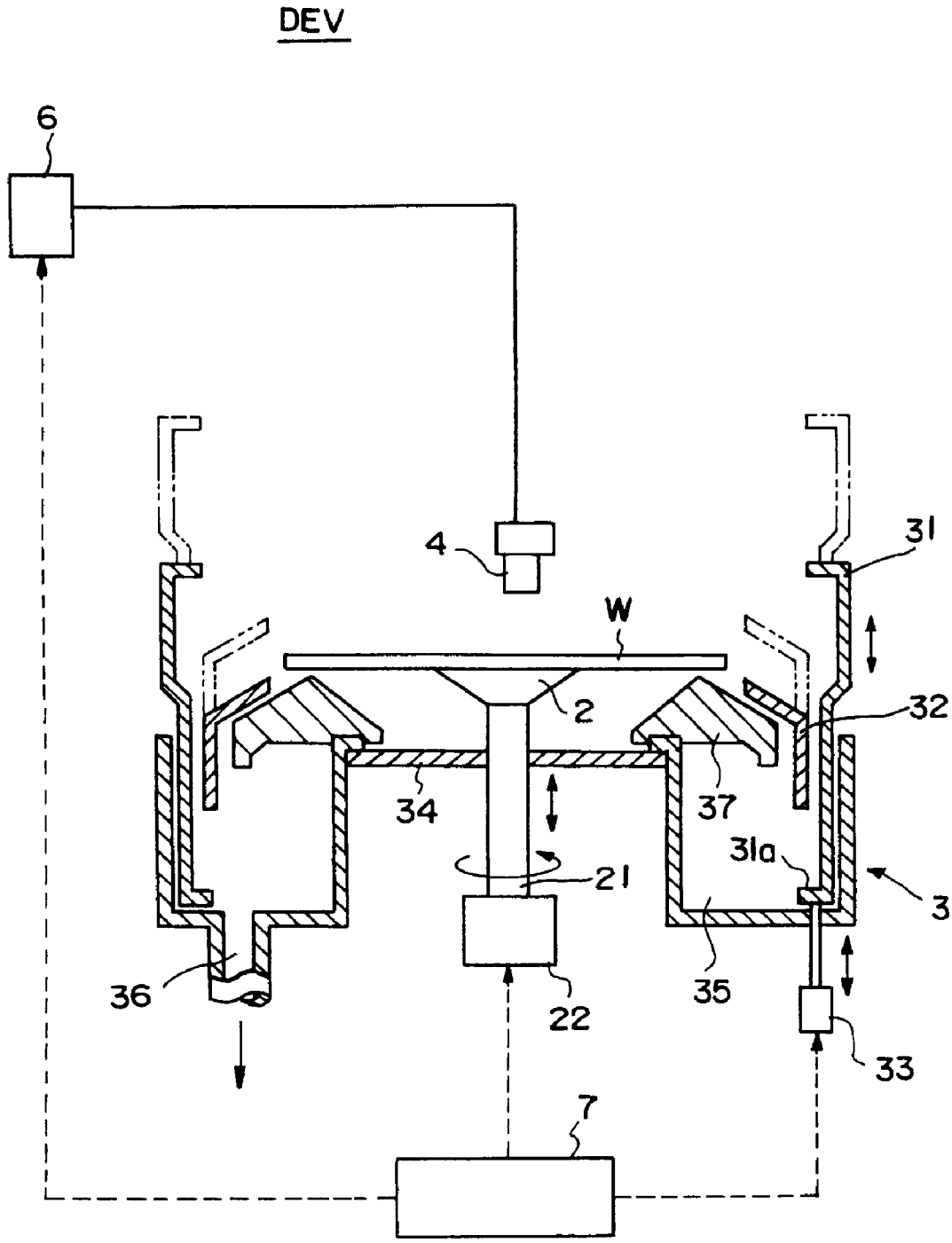
FIG. 3 is a cross-sectional view schematically showing a configuration of a developing unit as a developing apparatus according to the present invention.
Figure 4:
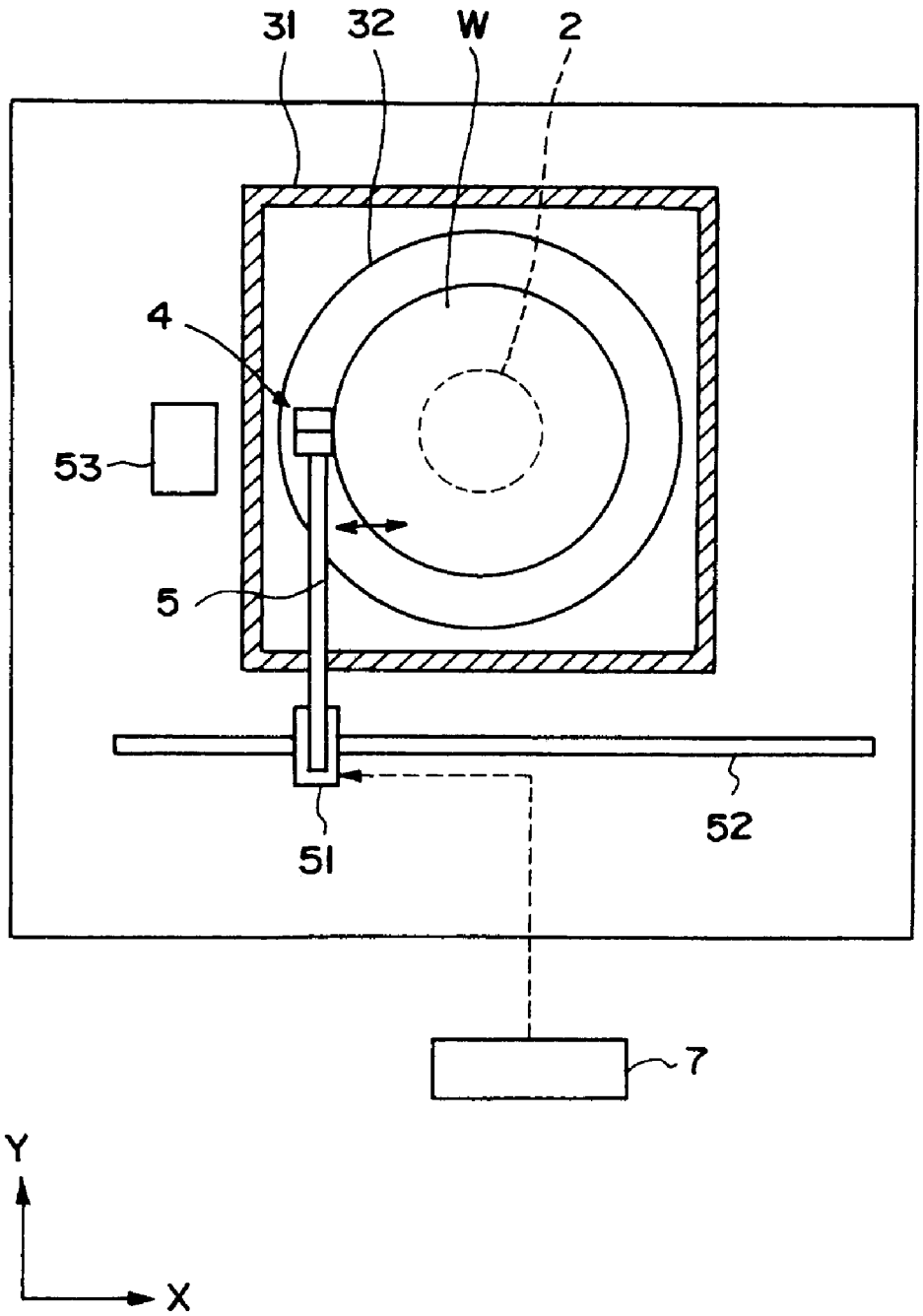
FIG. 4 is a plan view showing the developing unit shown in FIG. 3.

Next, developing unit DEV as the developing apparatus of the present invention will be described in detail. FIGS. 3 and 4 are respectively cross-sectional and plan views schematically showing a configuration of developing unit DEV.

Developing unit DEV includes a spin chuck 2 that is a substrate holding portion for holding a substrate, e.g., wafer W, in a horizontal attitude by holding the center of the back side of wafer W by suction. As shown in FIG. 3, spin chuck 2 is connected to a drive mechanism 22 that is a rotary drive mechanism via a rotational shaft 21, and configured to be capable of rotating and ascending/descending with wafer W held thereon. In the present embodiment, wafer W is set on spin chuck 2 such that the center of wafer W is positioned on the rotational axis of spin chuck 2. However, in the present invention, the center of wafer W need not necessarily be positioned on the rotational axis. The center of wafer W may be positioned in a region of a radius in a range of 1 to 15 mm centered about the rotational axis.

A cup body 3 having an opened top end is provided so as to surround wafer W on spin chuck 2. Cup body 3 is constituted of an outer cup 31 having a rectangular upper portion and a cylindrical lower portion, and an cylindrical inner cup 32 having an upper portion tilted inwardly. Outer cup 31 ascends and descends by an ascending/descending portion 33 connected to the lower end of outer cup 31. Inner cup 32 is configured to be capable of ascending when being pushed up by a step portion 31*a* formed on the inner circumferential surface of the lower end of outer cup 31.

As shown in FIG. 3, a circular plate 34 is provided below spin chuck 2. A liquid receiving portion 35 of which cross section is a concave shape is provided externally to and along the entire circumference of circular plate 34. A drain port 36 is formed in the bottom of liquid receiving portion 35. The developing solution and the rinse liquid that have dropped or been spun off from wafer W are trapped within liquid receiving portion 35, and are discharged to the outside of the apparatus through drain port 36.

A ring member 37 having a substantially triangular cross-sectional shape is provided externally to circular plate 34. Not-shown ascending/descending pins, which are for example three substrate holding pins penetrating through circular plate 34, are provided. These ascending/descending pins and a not-shown substrate carrying means cooperate to allow wafer W to be transferred to and from spin chuck 2.

Figure 5:
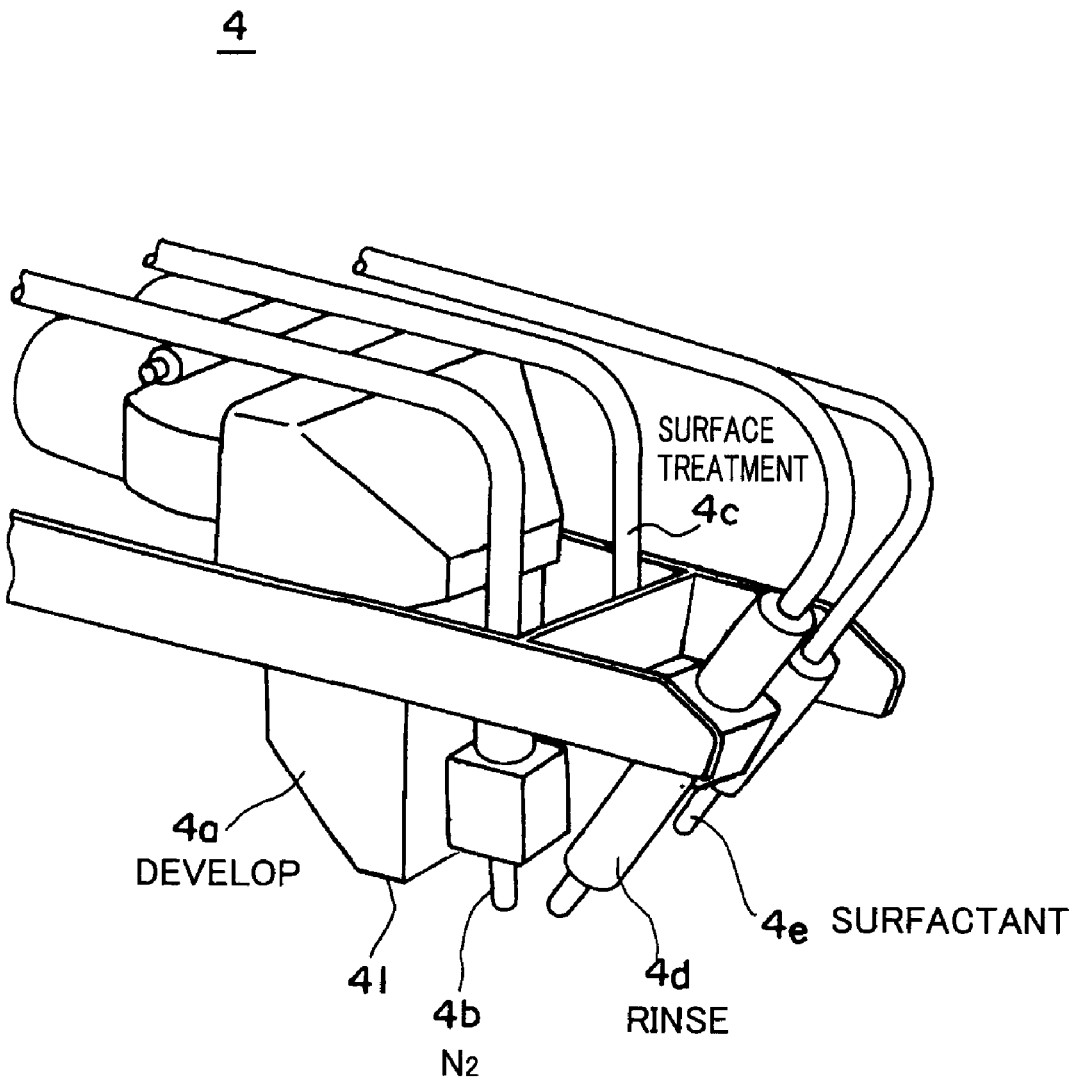
FIG. 5 is a perspective view of a complex nozzle provided in the developing unit shown in FIG. 3.

Opposing to the surface of wafer W held on spin chuck 2, a complex nozzle 4 capable of ascending/descending and moving horizontally is provided. As shown in FIG. 5, complex nozzle 4 is constituted of a plurality of nozzles being gathered. Among the nozzles, a developing solution nozzle 4*a* is formed in a wedge shape of which width is reduced as approaching the lower end. A slit-like discharge port 41 is formed in the lower end surface of developing solution nozzle 4*a* to discharge a developing solution in a form of a strip. Discharge port 41 is arranged such that its longitudinal direction is oriented from the periphery of wafer W to the center thereof.

It is configured such that developing solution nozzle 4*a* is supplied with a prescribed flow rate (e.g., 600 ml/min) of a developing solution from a developing solution supplying portion (not shown) of solution supplying portion 6 shown in FIG. 3. Solution supplying portion 6 is provided with a not-shown temperature adjusting mechanism, to adjust the developing solution to a prescribed temperature (e.g., 23° C.) and supply the nozzle with the developing solution. That is, as the developing solution is always supplied at a prescribed temperature, a group of wafers coated with the same type of resist can uniformly be subjected to developing processing.

As shown in FIG. 5, next to developing solution nozzle 4*a* in complex nozzle 4, a $N_2$ nozzle 4*b* for blowing $N_2$ gas as appropriate in the wafer surface and a surface treatment liquid nozzle 4*c* for discharging a small amount of rinse liquid, e.g., pure water, for the process of improving wettability of the wafer surface (pre-wet process) are provided. Further, a rinse liquid nozzle 4*d* for discharging a small amount of rinse liquid, e.g., pure water, for rinsing the developing solution out, and a surfactant nozzle 4*e* for supplying a surfactant.

The solution and $N_2$ gas supplied to respective nozzles of complex nozzle 4 are each supplied from solution supplying portion 6. The discharging angle of the nozzles are adjusted such that, when complex nozzle 4 moves and stops over the center of wafer W, the solution and the like respectively discharged are applied to the center of the wafer.

As shown in FIG. 4, complex nozzle 4 is supported on one end of a nozzle arm 5 that is a supporting member. The other end of nozzle arm 5 is connected to a moving base 51 as a moving mechanism, which is provided with a not-shown ascending/descending mechanism. Moving base 51 is configured to be capable of laterally moving along a guide member 52 as a moving mechanism extending in the X-direction on the bottom surface of the unit casing, for example. The moving mechanisms allow complex nozzle 4 to move on a straight line from the outside of wafer W to the center thereof. It is noted that a waiting portion 53 for complex nozzle 4 is provided externally to cup body 3, where cleaning of the tip of each nozzle or the like is performed.

Specifically, control is exerted such that, when coating wafer W with the developing solution, complex nozzle 4 moves from nozzle waiting portion 53 to the periphery of wafer W, and that complex nozzle 4 moves from the outside of wafer W to the center thereof, while the developing solution is discharged in a form of a strip from discharge port 41 of developing solution nozzle 4*a*. Also, at this moment, control is exerted such that wafer W rotates at a prescribed rotation rate (e.g., 1000 rpm) driven by driving mechanism 22, whereby wafer W is coated with the developing solution, being discharged in a form of a strip, in a spiral manner.

In the figure, a control unit 7 constituted of a computer is shown. Control unit 7 has a function of controlling operations of solution supplying portion 6 (developing solution supplying portion), drive mechanism 22, ascending/descending portion 33, and moving base 51. Further, control unit 7 functions to control discharging of the developing solution and the rinse liquid supplied to wafer W. In particular, when discharging the developing solution, it controls such that the developing solution is supplied from developing solution nozzle 4*a* when complex nozzle 4 moves from the outside of wafer W to the center thereof, as described above. Further, it controls such that, when complex nozzle 4 (developing solution nozzle 4*a*) further moves to the center of the wafer, the developing solution is intermittently discharged from developing solution nozzle 4*a* to the center of the wafer for a prescribed time with the nozzle in a stationary state.

More specifically, a not-shown storage unit provided in control unit 7 stores a developing processing program having: at least one processing recipe constituted of software in which a moving operation of complex nozzle 4, respective discharging operations of the nozzles, a rotating operation of wafer W and the like are determined in advance; and a command portion in which commands are arranged such that each operation is executed based on at least one processing recipe. Control unit 7 reads the program, and exerts control such that a developing step, which will be described later, is carried out. The developing processing program is stored in the storage unit of control unit 7 as recorded and stored in a storage medium such as hard disk, compact disk, magneto-optical disk, and a memory card, for example.

Next, steps of developing wafer W using developing unit DEV will be described. In the developing processing, the processing recipe is determined depending on various conditions such as the type of the resist to be used, the type of the resist pattern to be formed (line type, hole type and the like)

and the like. In the following description, it is assumed that the developing processing is carried out based on a processing recipe R1 shown in FIG. 6 under control by control unit 7. In this case, the pattern formed on wafer W is a line type pattern, for example, and the used photoresist is KrF resist M20G available from JSR Corporation, for example. For example, the temperature of the developing solution is set to 23° C., with the discharging flow rate of the developing solution from developing solution nozzle 4*a* being set to 600 ml/min, and discharging flow rate of the rinse liquid from rinse liquid nozzle 4*d* being set to 1000 ml/min.

First, in a state where outer cup 31 and inner cup 32 are at their descended positions and complex nozzle 4 is arranged above nozzle waiting portion 53, wafer W, of which surface has been coated with resist and further has been exposed, is put into by a not-shown substrate carrying means. This substrate carrying means and not-shown ascending/descending pins cooperate to transfer wafer W to spin chuck 2.

Next, outer cup 31 and inner cup 32 are set to their ascended positions, and complex nozzle 4 is arranged at the position where discharging of developing solution should be started, which is, for example, slightly outside the periphery of wafer W on one side of wafer W and is slightly higher than the surface of wafer W (referred to as the start position).

Then, complex nozzle 4 is moved to above the center of wafer W while wafer W is rotated around a vertical axis at a rotation rate of 500 rpm, for example (step S1 in FIG. 6).

Next, while a small amount of the rinse liquid, e.g., pure water, is supplied from surface treatment liquid nozzle 4*c* to wafer W, complex nozzle 4 is moved toward the start position at the periphery of wafer W. Thus, the pre-wet processing over the entire wafer W surface, that is, the processing for improving the wettability of the wafer surface is performed, attaining the state where the developing solution supplied thereafter will quickly spread over the surface of wafer W (steps S2 and S3 in FIG. 6).

Figure 7A:
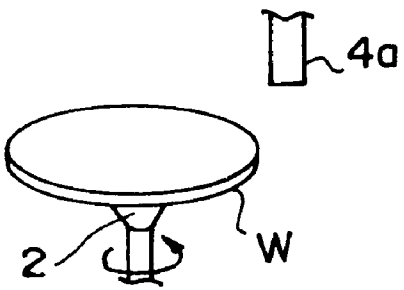
FIGS. 7A-7D schematically show a step of coating a developing solution.
Figure 7B:
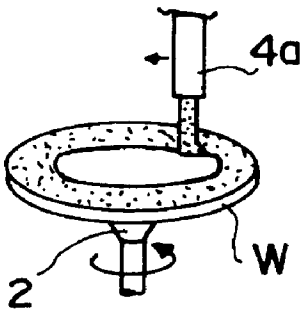

Complex nozzle 4 (developing solution nozzle 4*a*) moved to the start position as shown in FIG. 7A waits for a prescribed time (step S4 in FIG. 6; 0.1 seconds in FIG. 6). Thereafter, as shown in FIG. 7B, complex nozzle 4 starts supplying the developing solution from developing solution nozzle 4*a* (step S5 in FIG. 6), and moves toward the center of wafer W while maintaining supply of the developing solution (step S6 in FIG. 6).

Figure 8:
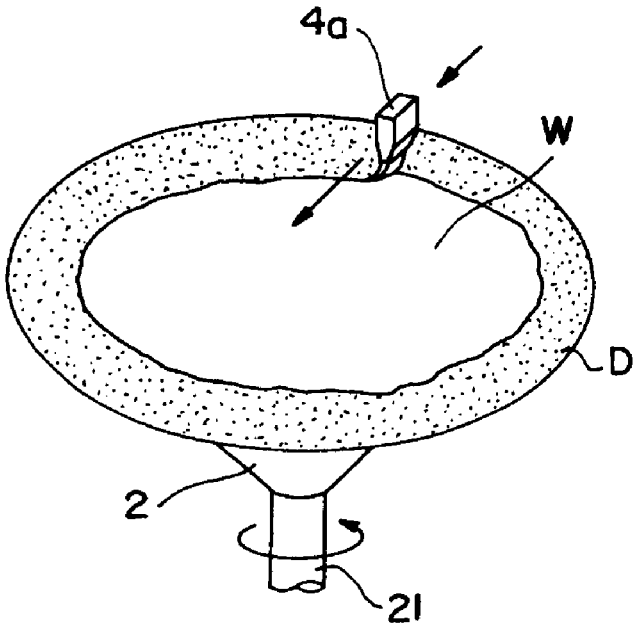
FIG. 8 schematically shows a manner of the developing solution being spirally coated on a wafer.
Figure 9:
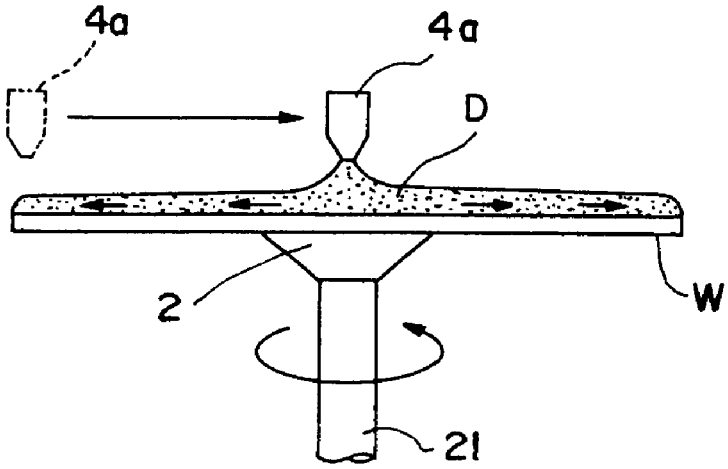
FIG. 9 schematically shows a manner of the developing solution being spread by the rotation of the wafer (centrifugal force).
Figure 13A:
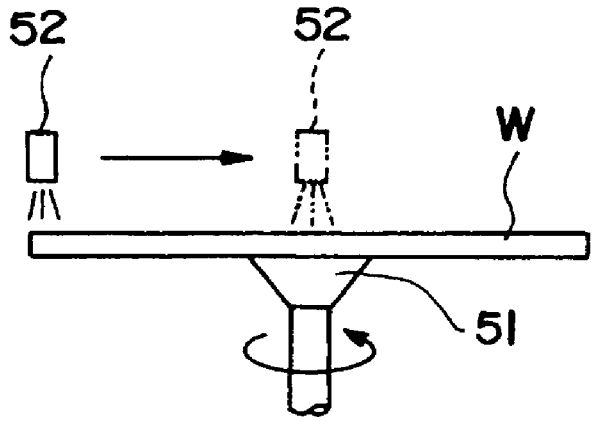
FIG.13A PRIOR ART
FIGS. 13A-13C relate to a description of an example of the conventional stationary puddle scheme.
Figure 13B:
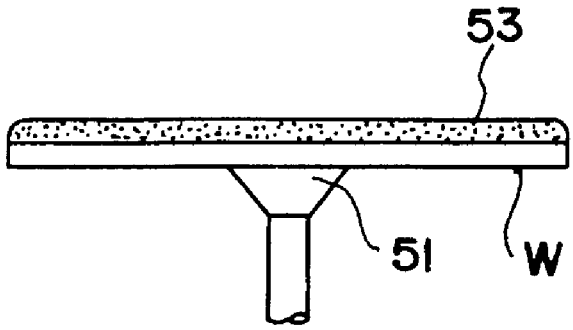
FIG.13B PRIOR ART
Figure 13C:
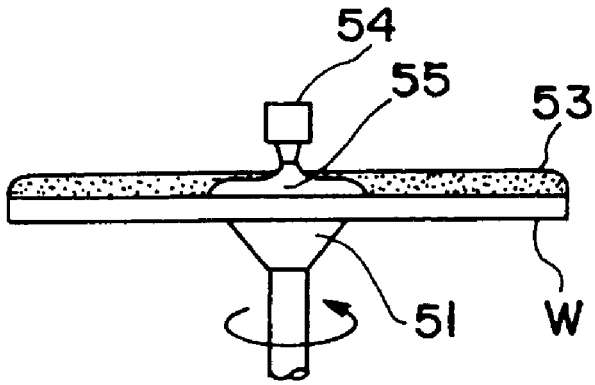
FIG.13C PRIOR ART

For example as schematically shown in FIG. 8, developing solution D discharged in a strip shape is arranged from the outside toward the inside of wafer W without creating a gap, so that developing solution D is spirally supplied over the entire surface of wafer W. As shown in FIG. 9, developing solution D spreads outward on the surface of rotating wafer W due to centrifugal force, thereby forming a thin liquid film on the surface of wafer W.

Figure 7C:
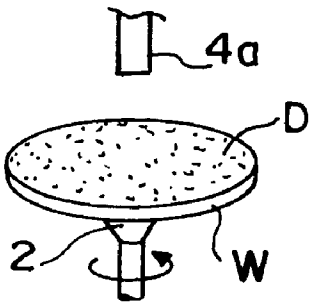
Figure 7D:
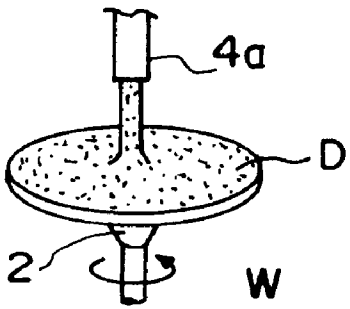

Developing solution nozzle 4*a* moved to above the center of wafer W as shown in FIG. 7C waits for a prescribed time (2.5 seconds in FIG. 6) (step S7 in FIG. 6). Thereafter, developing solution nozzle 4*a* supplies again the developing solution to the center of wafer W for a prescribed time (2.5 seconds in FIG. 6) as shown in FIG. 7D (step S8 in FIG. 6). Developing solution nozzle 4*a* further waits for a prescribed time (2.5 seconds in FIG. 6) as shown in FIG. 7C (step S9 in FIG. 6). Thereafter, developing solution nozzle 4*a* supplies the developing solution to the center of wafer W for a prescribed time (2.5 seconds in FIG. 6) as shown in FIG. 7D (step S10 in FIG. 6).

That is, after developing solution nozzle 4*a* has moved to above the center of wafer W, the processing of intermittently supplying the developing solution is carried out. As shown in recipe R1 in FIG. 6, the rotation rate of wafer W in discharging the developing solution during the period of intermittently supplying the developing solution is set to 1000 rpm, and when discharging is stopped, it is set to 750 rpm, for example.

By developing solution nozzle 4*a* intermittently supplying the center of the wafer with the developing solution during steps S7-S10 as described above, when the developing solution is discharged after an intermittence, a large amount of developing solution gushes onto the center of the wafer. This efficiently flushes the resist dissolution components on wafer W away, accelerating the developing processing. Since the developing solution is coated over the entire wafer surface in step S6 in FIG. 6, dissolution of the resist is started before the developing solution is intermittently supplied, whereby the effect by the intermittent supply becomes further effective. Additionally, since the developing solution is coated over the entire substrate surface, the developing solution effectively spreads over the entire substrate surface when the developing solution is discharged onto the center of the substrate, achieving further even developing processing of the entire substrate surface.

In the intermittent supply of the developing solution during steps S7-S10, conditions such as the intermittence time (discharging stopped time), wafer rotation rate and the like are set so as to prevent the developing solution on wafer W from drying when the discharge of the developing solution is stopped during that period.

For example, as described above, in processing recipe R1, the intermittence time is set to 2.5 seconds when the wafer rotation rate when discharging of the developing solution is stopped is 750 rpm. Setting the wafer rotation rate when the developing solution discharging is stopped and the intermittence time in this manner prevents the developing solution from drying. As a result, the dissolved components of the resist is not fixed and occurrence of dry spots can be prevented.

Further, since the developing solution does not dry when the discharging of the developing solution is stopped, the developing processing continuously proceeds. As a result, the developing processing is carried out with the processing time equivalent to that of the conventional puddleless scheme in which the developing solution is continuously supplied, while the consumption amount of the developing solution is reduced than in the conventional scheme.

Although it has been described that in the example of recipe R1 the wafer rotation rate is 750 rpm and the intermittence time is 2.5 seconds, the developing processing method of the present invention is not limited thereto. For example, it is preferable that the intermittence time is set to at most 2 seconds when the wafer rotation rate while the developing solution discharging is stopped is 1000 rpm, and it is preferable that the intermittence time is set to at most 3.5 seconds when the wafer rotation rate while the developing solution discharging is stopped is 500 rpm.

When the developing processing by the developing solution supply is finished, complex nozzle 4 waits for a prescribed time above the center of wafer W (step S11 in FIG. 6; 0.5 seconds in FIG. 6), and thereafter the rinse liquid, e.g., pure water, is supplied from rinse liquid nozzle 4*d* to the center of wafer W for two seconds with the wafer rotation rate of 100 rpm (step S12 in FIG. 6), for three seconds with the wafer rotation rate of 1200 rpm (step S13 in FIG. 6), and further for 10 seconds with the wafer rotation rate of 500 rpm (step S14 in FIG. 6).

The rinse liquid supplied to the surface of wafer W spreads outward on the surface of wafer W due to centrifugal force, rinsing out the developing solution containing dissolved resist components from wafer W to form a prescribed resist pattern.

Subsequently, the spin-dry processing of wafer W, in which wafer W is rotated at a high speed, e.g., 2000 rpm, so that liquids on the wafer surface are spun-off, is performed, during which complex nozzle 4 returns to the start position (step S15 in FIG. 6).

Although it is not included in the steps of recipe R1, a step of supplying surfactant on the surface of wafer W from surfactant nozzle 4*e* may be carried out before the series of spin-dry processing. By supplying the surfactant before spin-drying, liquids adhering to the surface of the pattern (in particular, in a trough of the pattern) can quickly be spun off in the spin drying with small friction. This can prevent the problem of the pattern being pulled by the liquids spun off in the spin drying and thereby falling.

After the spin-dry processing, the rotation of wafer W is stopped, and outer cup 31 and inner cup 32 descend. Complex nozzle 4 moves to above nozzle waiting portion 53. Thus, the developing processing ends (step S16 in FIG. 6).

As above, according to the embodiment of the present invention, by intermittently supplying the developing solution to the center of wafer W of which rotation is controlled, the developing processing is performed. By the intermittent supply, when the developing solution is discharged after an intermittence, a large amount of developing solution gushes onto the center of the wafer. This efficiently flushes the resist dissolution components on wafer W away, accelerating the developing processing and reducing the developing time. By setting the wafer rotation rate and the intermittence time such that the developing solution on wafer W does not dry when discharging of the developing solution is stopped in the developing solution intermittent supply processing, the developing solution can be prevented from drying. As a result, the developing processing continuously proceeds and the consumption amount of the developing solution can be reduced. Further, since the resist dissolved components are not fixed, occurrence of dry spots can be prevented.

Although in the present embodiment the example has been shown in which, in the process of supplying the developing solution to wafer W, firstly the developing solution is movably discharged from the outside of rotating wafer W toward the center thereof, and thereafter the developing solution is intermittently supplied at the center of the wafer, the invention is not limited to this manner. The process of discharging the developing solution may be carried out only at the center of wafer W.

Further, although in the present embodiment complex nozzle 4 constituted of a group of a plurality of nozzles such as developing solution nozzle 4*a*, rinse liquid nozzle 4*d* and the like has been shown as an example and the moving mechanism of the nozzles has been described to be a common mechanism, the nozzles and their respective moving mechanisms may independently be provided.

Still further, although as an example of a substrate a wafer has been used in the description, the substrate processed by the developing apparatus and developing processing method of the present invention is not limited to a wafer. The present invention is applicable to a substrate being processed through the photolithography step, such as an LDC substrate.

EXAMPLES

Next, the developing apparatus and developing processing method of the present invention will further be described based on examples. In the present Examples, the developing apparatus shown in the embodiment above was manufactured. Conducting experiments using the developing apparatus, the effect thereof was verified. As the substrate to be processed, a 300 mm-diameter wafer was used.

Experiment 1

Example 1

As Example 1, recipe R1 shown in FIG. 6 was used. The developing processing was carried out under the condition shown in Table 1 and the consumption amount of the developing solution was measured.

TABLE 1

| | |
|---|---|
| Resist material | KrF resist M20G available from JSR Corporation |
| Pattern type | Line type pattern |
| Flow rate of developing solution | 600 ml/min |
| Temperature of developing solution | 23° C. |
| Flow rate of rinse liquid | 1000 ml/min |
| Period of supplying developing solution at the center position (developing time) | 10 sec |

In Example 1, as a result of Experiment 1, a sufficient developing result was obtained, and the consumption amount of the developing solution was 71 ml.

Comparative Example 1

Using recipe R2 shown in FIG. 10, the developing processing was carried out under the condition of Table 1, and the consumption amount of the developing solution therein was measured. As shown in recipe R2, in Comparative Example 1, the supply of the developing solution to the center of the wafer was continuously performed as in the conventional puddleless scheme.

As a result of Comparative Example 1, the development result equivalent to that of Example 1 was obtained, and the consumption amount of the developing solution was 121 ml. That is, according to Example 1, a great reduction in the consumption amount of the developing solution was achieved as compared to the puddleless scheme of Comparative Example 1.

Experiment 2

Example 2

As Example 2, recipe R3 shown in FIG. 11 was used. The developing processing was carried out under the condition shown in Table 2 and the consumption amount of the developing solution therein was measured.

TABLE 2

| | |
|---|---|
| Resist material | KrF resist SL1530 available from ROHM & HASS |
| Pattern type | Line type pattern |
| Flow rate of developing solution | 600 ml/min |
| Temperature of developing solution | 23° C. |
| Flow rate of rinse liquid | 1000 ml/min |
| Period of supplying developing solution at the center position (developing time) | 15 sec |

In Example 2, a sufficient developing result was obtained, and the consumption amount of the developing solution was 96 ml.

Comparative Example 2

Using recipe R4 shown in FIG. 12, the developing processing was carried out under the condition of Table 2, and the consumption amount of the developing solution therein was measured. As shown in recipe R4, in Comparative Example 2, the supply of the developing solution to the center of the wafer was continuously performed as in the conventional puddleless scheme.

As a result of Comparative Example 2, the development result equivalent to that of Example 2 was obtained, and the consumption amount of the developing solution was 171 ml. That is, according to Example 2, a great reduction in the consumption amount of the developing solution was achieved as compared to the puddleless scheme of Comparative Example 2.

Experiment 3

As to the intermittent supply of the developing solution to the center of the wafer, the optimum combination of the wafer rotation rate when the discharging is stopped and the intermittence time for preventing drying of the developing solution was verified. Specifically, the surface of the wafer after development was observed, and the result was evaluated depending on whether there are dry spots on the surface. The wafers employing KrF resist M20G available from JSR Corporation as the resist material and subjected to the exposure processing were used. The result of Experiment 3 is shown in Table 3.

TABLE 3

| | Intermittence time (sec) | | | | | | | | | |
|---|---|---|---|---|---|---|---|---|---|---|
| Wafer rotation rate | 2.0 | 2.5 | 3.0 | 3.5 | 4.0 | 4.5 | 5.0 | 6.0 | 7.0 | 8.0 |
| 1000 | OK | NG | NG | NG | NG | | | | | |
| 750 | OK | OK | NG | NG | NG | | | | | |
| 500 | OK | OK | OK | OK | NG | | | | | |
| 300 | OK | OK | OK | OK | OK | OK | NG | NG | NG | NG |
| 200 | OK | OK | OK | OK | OK | OK | OK | OK | NG | NG |
| 100 | OK | OK | OK | OK | OK | OK | OK | OK | OK | OK |

OK - no dry spots;
NG - dry spots present

As shown in Table 3, no dry spots occurred up to the intermittence time of 2.0 seconds when wafer rotation rate was 1000 rpm; up to the intermittence time of 2.5 seconds when wafer rotation rate was 750 rpm; up to the intermittence time of 3.5 seconds when wafer rotation rate was 500 rpm; up to the intermittence time of 4.5 seconds when wafer rotation rate was 300 rpm; up to the intermittence time of 6.0 seconds when wafer rotation rate was 200 rpm; and up to the intermittence time of 8.0 seconds when wafer rotation rate was 100 rpm. Thus, the applicable range of the developing processing method of the present invention was confirmed.

Experiment 4

Using recipe R5 shown in FIG. 14, the developing processing was carried out under the condition of Table 1, and the consumption amount of the developing solution therein was measured.

As a result of Experiment 4, the development result equivalent to that of Example 1 was obtained.

From the experiment results of Examples, it was confirmed that the developing apparatus and the developing processing method of the present invention can reduce the consumption amount of the developing solution and the developing processing time as compared to the stationary puddle scheme.

The present invention is applicable to the developing apparatus that carries out the developing processing on semiconductor wafers, LCD substrates or the like having been coated with photoresist and exposed. It can suitably be used in the field of semiconductor manufacture, electronic device manufacture and the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing processing method of performing developing processing on a substrate after having its surface coated with a resist and exposed, comprising the steps of:

horizontally holding said substrate and rotating said substrate around a vertical axis at a prescribed rotation rate;

moving a developing solution nozzle from a periphery of the substrate to a center of the substrate while a developing solution is discharged from a discharge port of said developing solution nozzle arranged opposing to the surface of said substrate;

stopping discharge of the developing solution from said developing solution nozzle after said developing solution nozzle reached above the center of said substrate; and holding said substrate and rotating said substrate around a vertical axis at a prescribed rotation rate for a prescribed time in a state where discharge of the developing solution from said developing solution nozzle is stopped.

2. The developing processing method according to claim 1, wherein in said step of stopping discharge of the developing solution from said developing solution nozzle after said developing solution nozzle reached above the center of said substrate, during a prescribed time after said developing solution nozzle reached above the center of said substrate and until discharge of the developing solution is stopped, the developing solution is continuously discharged or intermittently discharged from said nozzle to the surface of said substrate.

3. The developing processing method according to claim 1, wherein in said step of holding said substrate and rotating said substrate around a vertical axis at a prescribed rotation rate for a prescribed time in a state where discharge of the developing solution from said developing solution nozzle is stopped, a substrate rotation rate and a substrate holding time are at most 1000 rpm and at most 2.0 seconds, respectively.

4. The developing processing method according to claim 1, wherein in said step of holding said substrate and rotating said substrate around a vertical axis at a prescribed rotation rate for a prescribed time in a state where discharge of the developing solution from said developing solution nozzle is stopped, a substrate rotation rate and a substrate holding time are at most 750 rpm and at most 2.5 seconds, respectively.

5. The developing processing method according to claim 1, wherein in said step of holding said substrate and rotating said substrate around a vertical axis at a prescribed rotation rate for a prescribed time in a state where discharge of the developing solution from said developing solution nozzle is stopped, a substrate rotation rate and a substrate holding time are at most 500 rpm and at most 3.5 seconds, respectively.

6. The developing processing method according to claim 1, wherein in said step of holding said substrate and rotating said substrate around a vertical axis at a prescribed rotation rate for a prescribed time in a state where discharge of the developing solution from said developing solution nozzle is stopped, a substrate rotation rate and a substrate holding time are at most 200 rpm and at least 5.0 seconds, respectively.

7. A developing apparatus that performs developing processing on a substrate having a surface coated with a resist and exposed, comprising:

a substrate holding portion that horizontally holds said substrate;

a rotary drive mechanism that rotates said substrate holding portion around a vertical axis;

a developing solution nozzle that is arranged opposite to the surface of a port that discharges a developing solution;

a developing solution supplying portion that supplies the developing solution to said developing solution nozzle; and a control unit that controls operations of said rotary drive mechanism and said developing solution supplying portion, wherein said control unit controls said rotary drive mechanism such that said substrate rotates around the vertical axis at a first prescribed rotation rate, and controls said developing solution supplying portion such that supply of the developing solution from the discharge port of said developing solution nozzle to a center of said substrate is temporarily stopped, said control unit controls said rotary drive mechanism such that said substrate rotates around the vertical axis at a second prescribed rotation rate, and controls said developing solution supplying portion such that the developing solution nozzle intermittently supplies the developing solution from the discharge port to the center of said substrate, and the first prescribed rotation rate and a discharging stopped time of the developing solution are at most 1000 rpm and at most 2.0 seconds, respectively.

8. A developing apparatus that performs developing processing on a substrate having a surface coated with a resist and exposed, comprising:

a substrate holding portion that horizontally holds said substrate;

a rotary drive mechanism that rotates said substrate holding portion around a vertical axis;

a developing solution nozzle that is arranged opposite to the surface of a port that discharges a developing solution;

a developing solution supplying portion that supplies the developing solution to said developing solution nozzle; and a control unit that controls operations of said rotary drive mechanism and said developing solution supplying portion, wherein said control unit controls said rotary drive mechanism such that said substrate rotates around the vertical axis at a first prescribed rotation rate, and controls said developing solution supplying portion such that supply of the developing solution from the discharge port of said developing solution nozzle to a center of said substrate is temporarily stopped, said control unit controls said rotary drive mechanism such that said substrate rotates around the vertical axis at a second prescribed rotation rate, and controls said developing solution supplying portion such that the developing solution nozzle intermittently supplies the developing solution from the discharge port to the center of said substrate, and the first prescribed rotation rate and a discharging stopped time of the developing solution are at most 750 rpm and at most 2.0 seconds, respectively.

9. A developing apparatus that performs developing processing on a substrate having a surface coated with a resist and exposed, comprising:

a substrate holding portion that horizontally holds said substrate;

a rotary drive mechanism that rotates said substrate holding portion around a vertical axis;

a developing solution nozzle that is arranged opposite to the surface of said substrate held by said substrate holding portion and that has a discharge port that discharges a developing solution;

a developing solution supplying portion that supplies the developing solution to said developing solution nozzle; and a control unit that controls operations of said rotary drive mechanism and said developing solution supplying portion, wherein said control unit controls said rotary drive mechanism such that said substrate rotates around the vertical axis at a first prescribed rotation rate, and controls said developing solution supplying portion such that supply of the developing solution from the discharge port of said developing solution nozzle to a center of said substrate is temporarily stopped, said control unit controls said rotary drive mechanism such that said substrate rotates around the vertical axis at a second prescribed rotation rate, and controls said developing solution supplying portion such that the developing solution nozzle intermittently supplies the developing solution from the discharge port to the center of said substrate, and the first prescribed rotation rate and a discharging stopped time of the developing solution are at most 500 rpm and at most 3.5 seconds, respectively.

10. A developing apparatus that performs developing processing on a substrate having a surface coated with a resist and exposed, comprising:

a substrate holding portion that horizontally holds said substrate;

a rotary drive mechanism that rotates said substrate holding portion around a vertical axis;

a developing solution nozzle that is arranged opposite to the surface of said substrate held by said substrate holding portion and that has a discharge port that discharges a developing solution;

a developing solution supplying portion that supplies the developing solution to said developing solution nozzle; and a control unit that controls operations of said rotary drive mechanism and said developing solution supplying portion, wherein said control unit controls said rotary drive mechanism such that said substrate rotates around the vertical axis at a first prescribed rotation rate, and controls said developing solution supplying portion such that supply of the developing solution from the discharge port of said developing solution nozzle to a center of said substrate is temporarily stopped, said control unit controls said rotary drive mechanism such that said substrate rotates around the vertical axis at a second prescribed rotation rate, and controls said developing solution supplying portion such that the developing solution nozzle intermittently supplies the developing solution from the discharge port to the center of said substrate, and the first presented rotation rate and a discharging stopped time of the developing solution are at most 200 rpm and at most 5.0 seconds, respectively.

11. The developing apparatus according to claim 10, wherein said control unit controls said rotary drive mechanism to reduce the rotation rate of the substrate to the first presented rotation rate during the temporary stop of the supply of the developing solution.

12. The developing apparatus according to claim 11, wherein the first presented rotation rate is a rotation rate with which a film of the developing solution is held over the surface of the substrate.

13. The developing apparatus according to claim 10, further comprising:

a moving mechanism that moves said developing solution nozzle from a periphery of said substrate toward the center of said substrate, wherein the control unit controls, before the developing solution is intermittently supplied to the center of the substrate, said developing solution supplying portion and said moving mechanism such that said developing solution nozzle is moved from the periphery of the substrate to the center of the substrate while the developing solution is discharged from the discharge port of said developing solution nozzle to spirally supply the developing solution to the surface of the substrate.

14. A developing processing method of performing developing processing on a substrate having a surface coated with a resist and exposed, comprising:

horizontally holding said substrate;

rotating said substrate around a vertical axis at a first prescribed rotation rate and intermittently supplying a developing solution to a center of said substrate from a discharge port of a developing solution nozzle arranged opposite to a surface of the substrate;

temporarily stopping the supply of the developing solution from the discharge port of said developing solution nozzle, and controlling the substrate to rotate around the vertical axis at a second prescribed rotation rate, wherein the second prescribed rotation rate and a discharging stopped time of the developing solution are at most 1000 rpm and at most 2.0 seconds, respectively.

15. The developing processing method according to claim 14, further comprising:

before said intermittently supplying the developing solution to the center of said substrate, moving said developing solution nozzle from a periphery of the substrate to the center of the substrate while the developing solution is discharged from the discharge port of said developing solution nozzle to spirally supply the developing solution to the surface of the substrate.

16. A developing processing method of performing developing processing on a substrate having a surface coated with a resist and exposed, comprising:

horizontally holding said substrate;

rotating said substrate around a vertical axis at a first prescribed rotation rate and intermittently supplying a developing solution to a center of said substrate from a discharge port of a developing solution nozzle arranged opposite to a surface of the substrate;

temporarily stopping the supply of the developing solution from the discharge port of said developing solution nozzle, and controlling the substrate to rotate around the vertical axis at a second prescribed rotation rate, wherein the second prescribed rotation rate and a discharging stopped time of the developing solution are at most 750 rpm and at most 2.5 seconds, respectively.

17. The developing processing method according to claim 16, further comprising:

before said intermittently supplying the developing solution to the center of said substrate, moving said developing solution nozzle from a periphery of the substrate to the center of the substrate while the developing solution is discharged from the discharge port of said developing solution nozzle to spirally supply the developing solution to the surface of the substrate.

18. A developing processing method of performing developing processing on a substrate having a surface coated with a resist and exposed, comprising:

horizontally holding said substrate;

rotating said substrate around a vertical axis at a first prescribed rotation rate and intermittently supplying a developing solution to a center of said substrate from a discharge port of a developing solution nozzle arranged opposite to a surface of the substrate;

temporarily stopping the supply of the developing solution from the discharge port of said developing solution nozzle, and controlling the substrate to rotate around the vertical axis at a second prescribed rotation rate, wherein the second prescribed rotation rate and a discharging stopped time of the developing solution are at most 500 rpm and at most 3.5 seconds, respectively.

19. The developing processing method according to claim 18, further comprising:

before said intermittently supplying the developing solution to the center of said substrate, moving said developing solution nozzle from a periphery of the substrate to the center of the substrate while the developing solution is discharged from the discharge port of said developing solution nozzle to spirally supply the developing solution to the surface of the substrate.

20. A developing processing method of performing developing processing on a substrate having a surface coated with a resist and exposed, comprising:

horizontally holding said substrate;

rotating said substrate around a vertical axis at a first prescribed rotation rate and intermittently supplying a developing solution to a center of said substrate from a discharge port of a developing solution nozzle arranged opposite to a surface of the substrate;

temporarily stopping the supply of the developing solution from the discharge port of said developing solution nozzle, and controlling the substrate to rotate around the vertical axis at a second prescribed rotation rate, wherein the second prescribed rotation rate and a discharging stopped time of the developing solution are at most 200 rpm and at most 5.0 seconds, respectively.

21. The developing processing method according to claim 20, further comprising, before said intermittently supplying the developing solution to the center of said substrate, moving said developing solution nozzle from a periphery of the substrate to the center of the substrate while the developing solution is discharged from the discharge port of said developing solution nozzle to spirally supply the developing solution to the surface of the substrate.

22. A non-transitory computer readable storage medium, with instructions stored thereon, which when executed by a processor of a computer, causes the computer to execute a method of a developing processing method of performing developing processing on a substrate after having a surface coated with a resist and exposed, comprising:

horizontally holding said substrate and rotating said substrate around a vertical axis at a prescribed rotation rate;

moving a developing solution nozzle from a periphery of the substrate to a center of the substrate while a developing solution is discharged from a discharge port of said developing solution nozzle arranged opposing to the surface of said substrate;

stopping discharge of the developing solution from said developing solution nozzle after said developing solution nozzle reached above the center of said substrate; and holding said substrate and rotating said substrate around a vertical axis at a prescribed rotation rate for a prescribed time in a state where discharge of the developing solution from said developing solution nozzle is stopped.

23. The non-transitory computer readable storage medium according to claim 22, wherein in said stopping discharge of the developing solution from said developing solution nozzle after said developing solution nozzle reached above the center of said substrate, during a prescribed time after said developing solution nozzle reached above the center of said substrate and until discharge of the developing solution is stopped, the developing solution is continuously discharged or intermittently discharged from said nozzle to the surface of said substrate.

24. The non-transitory computer-readable storage medium according to claim 22, wherein in said holding said substrate and rotating said substrate around a vertical axis at a prescribed rotation rate for a prescribed time in a state where discharge of the developing solution from said developing solution nozzle is stopped, a substrate rotation rate and a substrate holding time are at most 1000 rpm and at most 2.0 seconds, respectively.

25. The non-transitory computer-readable storage medium according to claim 22, wherein in said holding said substrate and rotating said substrate around a vertical axis at a prescribed rotation rate for a prescribed time in a state where discharge of the developing solution from said developing solution nozzle is stopped, a substrate rotation rate and a substrate holding time are at most 750 rpm and at most 2.5 seconds, respectively.

26. The non-transitory computer-readable storage medium according to claim 22, wherein in said holding said substrate and rotating said substrate around a vertical axis at a prescribed rotation rate for a prescribed time in a state where discharge of the developing solution from said developing solution nozzle is stopped, a substrate rotation rate and a substrate holding time are at most 500 rpm and at most 3.5 seconds, respectively.

27. The non-transitory computer-readable storage medium according to claim 22, wherein in said holding said substrate and rotating said substrate around a vertical axis at a prescribed rotation rate for a prescribed time in a state where discharge of the developing solution from said developing solution nozzle is stopped, a substrate rotation rate and a substrate holding time are at most 200 rpm and at least 5.0 seconds, respectively.

* * * * *